US005320018A

United States Patent [19]

Fandrich

[11] Patent Number: 5,320,018

[45] Date of Patent: Jun. 14, 1994

[54] SOUND BOARD ASSEMBLY COMPRISING A CUT-OFF BAR HAVING AN ACOUSTICALLY FREE END

[76] Inventor: Delwin D. Fandrich, 114 S. I St., #800, Aberdeen, Wash. 98520

[21] Appl. No.: 3,533

[22] Filed: Jan. 12, 1993

[51] Int. Cl.[5] ..... G10C 3/06

[52] U.S. Cl. ..... 84/195; 84/212; 181/293

[58] Field of Search ..... 84/184, 187, 192, 195, 84/212; 181/292, 293

[56] References Cited

U.S. PATENT DOCUMENTS 3,248,990 5/1966 Bolin ..... 84/192
3,472,112 10/1969 Hanzotaguchi et al. ..... 84/192
3,641,861 2/1972 Anderson ..... 84/192

*Primary Examiner*—Michael L. Gellner
*Assistant Examiner*—Patrick J. Stanzione
*Attorney, Agent, or Firm*—Robert W. Jenny

[57] ABSTRACT

The sound board assembly is made up of a sound board, a plurality of ribs attached to one face of the sound board, two bridges attached to the other face of the sound board, a sound board liner and two cut-off bars. One cut-off bar is attached to the sound board and at each of its ends to the liner. The other is attached to the sound board and at one of its ends to the liner. The end attached to the liner is attached near an end of the rib near the end of the treble bridge which supports the highest treble string. The acoustically free end is positioned near the end of the bass bridge which supports the highest bass string.

2 Claims, 2 Drawing Sheets

SOUND BOARD ASSEMBLY COMPRISING A CUT-OFF BAR HAVING AN ACOUSTICALLY FREE END

BACKGROUND OF THE INVENTION

1. Field

The subject invention is in the field of pianos and, more specifically, in the field of sound board assemblies used in pianos. Still more specifically, it is in the field of the bridges, ribs and cut-off bars used in sound board assemblies and, in particular, the cut-off bars.

Prior Art

In manufacturing pianos, particularly upright pianos, considerable attention is addressed to the problems involved in providing desired tonal qualities and in avoiding tonal discontinuities along the scale of the piano. For example, the rate of decay of the tones produced in the range of the fifth octave of the piano may tend to be too rapid. Also substantial tonal discontinuity may occur between the higher notes produced by strings supported on the bridge for the bass strings (i.e. the bass bridge) and the lower notes produced by strings supported on the bridge for the tenor strings (i.e. the tenor/treble bridge).

Various techniques have been and are used in prior art pianos to minimize and attempt to avoid inconsistencies and discontinuities in tonal qualities and characteristics along the scale of a piano. FIGS. 1, 2 and 3 attached schematically illustrate examples of prior art techniques used on rectangular sound board assemblies and all involve the use of cut-off bars. Cut-off bars are pieces of structure attached to the sound board of the sound board assembly and to the frame to which the sound board is attached, the technical term for such a frame being the liner. Cut-off bars define and limit the effective working area of a rectangular sound board.

The sound board assembly in FIG. 1 comprises sound board 10, liner components 11, 12, 13 and 14, ribs 15 through 23, cut-off bars 24 and 25 and bridges 26 and 27 attached to the face of the sound board opposite to the face showing in this view. The phantom lines in all the drawings indicate the shapes and positions of bridge attached to the sound boards. Both cut-off bars are attached to the sound board and, at each of their ends, to a liner components. The sound board assemblies in FIGS. 2 and 3 are basically the same as that of FIG. 1, differing only in details of rib and bridge spacings and placements and in cut-off bar sizes and placements and, in the case of cut-off bar 28 in FIG. 3, the curved instead of straight shape. It is stated here for reference purposes that the operation of sound board assemblies is a function of the amounts and distribution of stiffness and mass over the area of the board and that the liner and cut-off bars effectively present infinite mass and stiffness where they contact the sound board.

These configurations, and others, have alleviated to various degrees and not eliminated the problems of discontinuities in tonal qualities and characteristics along the scale of a piano.

Accordingly, the primary objective of the subject invention is to provide a better solution to the problems noted above. Secondary objectives are that the solution be easily implemented and adapted to tuning techniques not possible in prior art solutions.

SUMMARY OF THE INVENTION

The subject invention is a sound board assembly comprising a cut-off bar having an acoustically free end. For purposes of this disclosure, the terminology "acoustically free" means that while one end of a cut-off bar may be structurally attached to other structures, the other end is still free to move in ways which affect the acoustic qualities of the piano. More specifically, the sound board assembly comprises a sound board, sound board liner, a plurality or ribs, two bridges and two cut-off bars. One cut-off bar is curved and conventional, being attached at each of its ends to a liner component and to the sound board along the length of the bar. The other cut-off bar is curved with one end attached to a liner component with the other end free to move with the sound board, the bar being attached to the sound board over at least a portion of its length. Also this cut-off bar is attached to the liner component near the end of the rib which is nearest to the bridge end which supports the highest treble string and extends along near the ends of adjacent ribs to a point near the bass bridge end which supports the highest bass string. The surface of this cut-off bar adjacent to the sound board may be recessed, such as for a distance from the acoustically free end, so that it does not touch the sound board or a rib over which it extends. In this way the cut-off bar adds mass to the sound board assembly in the area near the recess without adding stiffness. This bar may also be contoured, slit and otherwise modified to adjust its tonal effects, altering the mass and stiffness added to the sound board assembly along the length of the cut-off bar.

The invention is described in more detail below with reference to the attached drawings.

DETAILED DESCRIPTION OF THE INVENTION

Figure 1:
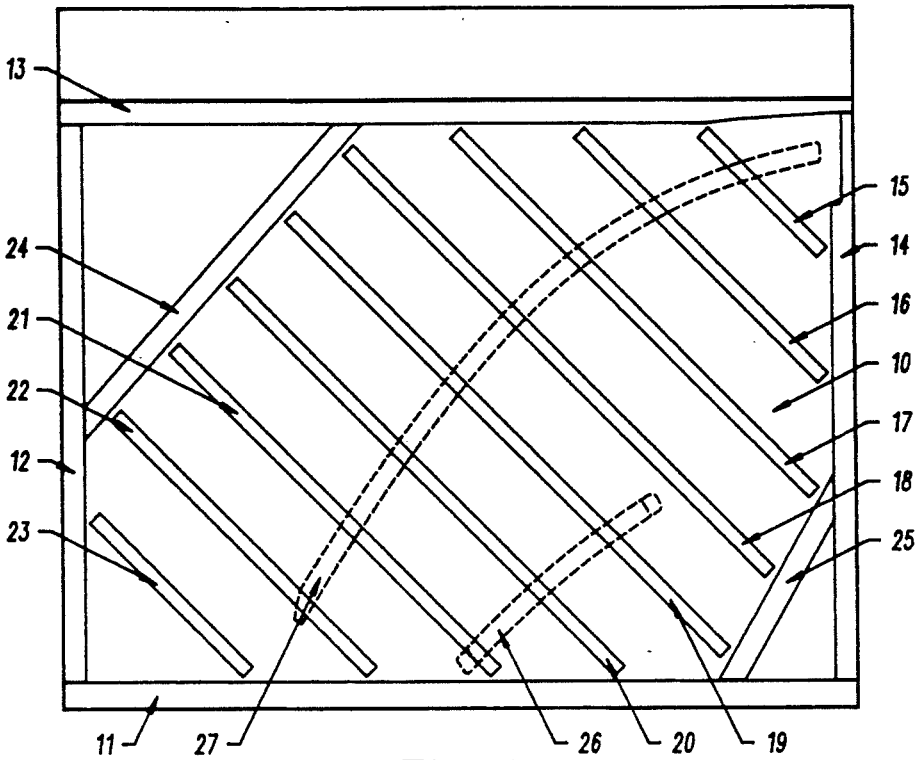
Fig. 1 Prior Art
FIGS. 1, 2 and 3 are schematic plan views of prior art sound board assemblies for upright pianos.
Figure 2:
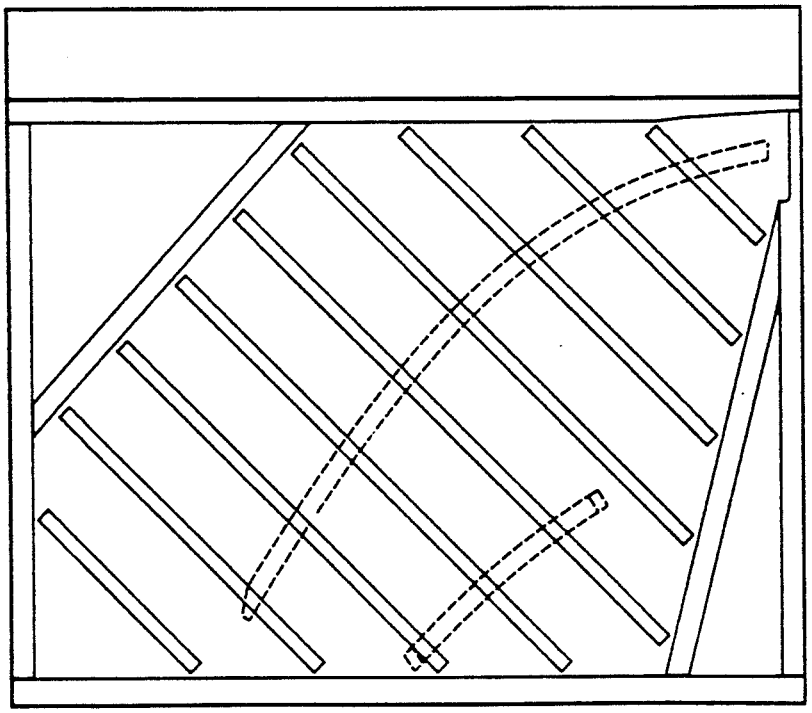
Fig. 2 Prior Art
Figure 3:
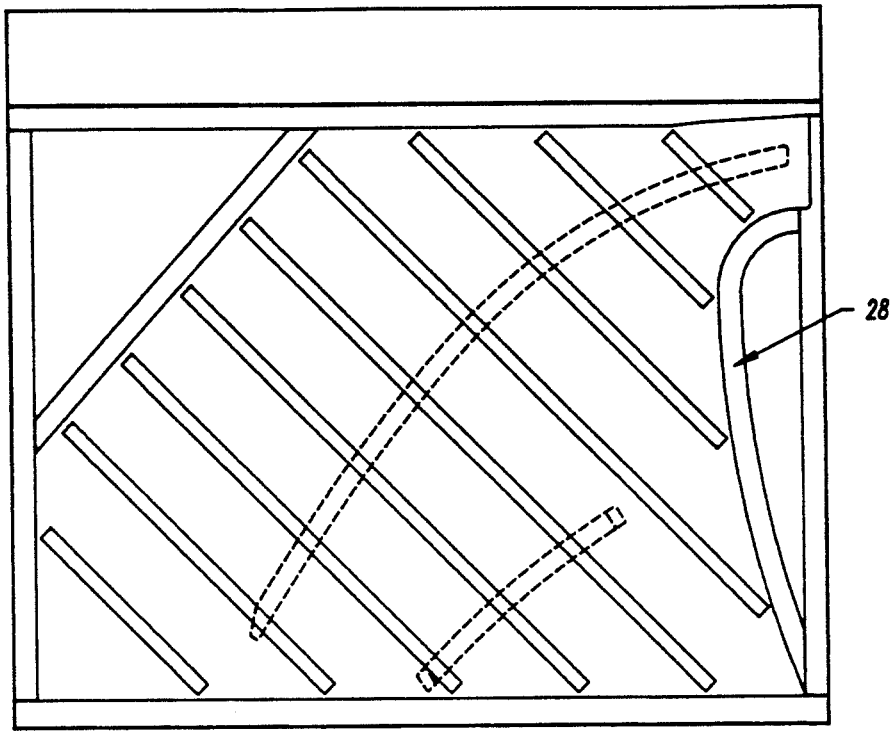
Fig. 3 Prior Art
Figure 4:
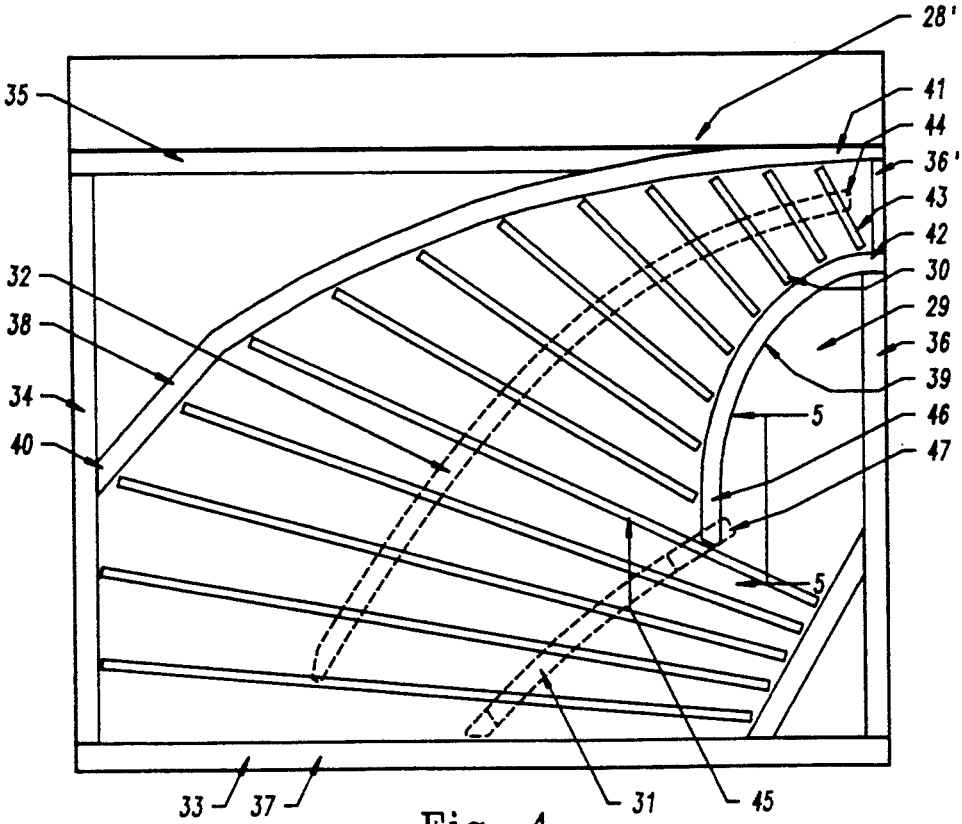
FIG. 4 is a schematic plan view of the subject sound board assembly.
Figure 5:
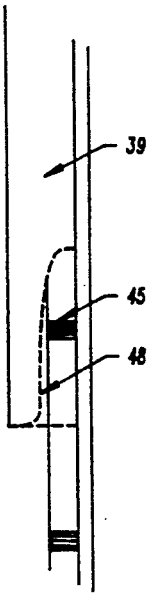
FIG. 5 is a sectional view of a cut-off bar taken from 5—5 in FIG. 4.

The subject invention is a sound board assembly comprising a cut-off bar having an acoustically free end. One embodiment of the invention is shown in FIG. 4, a schematic plan view of the sound board assembly for an upright piano. The assembly 28 comprises a sound board 29 a plurality of ribs, rib 30 being typical, bridges 31 and 32 (attached on the board face opposite the face showing in this view, their shapes and positions being indicated by the phantom lines), a liner 33 comprising components 34, 35, 36 and 37, cut-off bar 38 and cut-off bar 39. In other embodiments the sound board is not completely enclosed by the liner components. Cut-off bar 38 is prior art, with end 40 attached to liner component 34, end 41 attached to liner component 35 and functioning as a continuation of component 35, the bar being attached over its entire length to the sound board. Cut-off bar 39 is the salient part of the invention. Its end 42 is attached to liner component 36 near the end of rib 43 which is near end 44 of bridge 32, end 44 being the portion of the bridge which will support the highest treble string. Part 36' fills the liner gap between the two cut-off bars. Bar 39 extends past and close to the ends of adjacent ribs until it crosses rib 45 and its end 46 is close to end 47 of bridge 31, end 47 being the portion of this bridge which will support the highest bass string. FIG. 5 is a sectional view of cut-off bar 39 taken from 5—5 in FIG. 4 and illustrates relief cut-out 48 allowing bar 39 to extend over rib 45. Cut-off bar 39 is attached over all its length that is in contact with the sound board. The face of bar 39 visible in this view (FIG. 4) is also attached for a portion of the length of the bar extending from end 42 to wooden back structure of the piano, the wooden back structure not being shown in this disclosure. This added attachment proves additional mass on and high stiffness of the sound board in the area around that portion of the cut-off bar.

The techniques for determining and providing the amounts of mass and degrees of stiffness contributed to the sound board by cut-off bar 39 are not part of the invention since these techniques and determinations are within the capabilities of persons of ordinary skill in the art and the determinations depend on results desired, the characteristics of which are a matter of opinion. Nevertheless, having one end of the cut-off bar acoustically free allows more options for affecting tonal qualities by modifications of the cut-off bar than are available with prior art cut-off bars and given modifications may be more effective.

It has been found, in the development, manufacture and use of the Fandrich (TM) piano manufactured in Hoquiam, Wash., that the subject invention meets its objectives. It provides a superior solution to the problems faced in providing continuous tonal qualities and characteristics over the full scale of the piano. The cut-off bar with one end acoustically free lends itself well to detail changes affecting the amounts and distributions of stiffness and mass it contributes to the sound board assembly and the solutions this bar provides are easily implemented.

Also, it is considered to be understood that while certain embodiments of the invention are disclosed herein, other embodiments and modifications of those disclosed are possible within the scope of the invention which is limited only by the attached claims.

I claim:

1. A sound board assembly for use in a piano comprising a highest treble string and a highest bass string, said assembly comprising a sound board having first and second faces, a liner, a plurality of ribs, a bass bridge and a treble bridge and at least one cut-off bar having first and second ends, said liner and plurality of ribs being attached to said first face of said sound board, said bridges being attached to said second face of said sound board and said at least one cut-off bar being attached to said first face of said sound board and at said first end to said liner, whereby said second end is free of said liner and moves with said sound board.

2. The sound board assembly of claim 1 in which said bass bridge has an end which supports said highest bass string and said treble bridge has an end which supports said highest treble string and one of said ribs is near said end of said treble bridge and has a first rib end and said first end of said at least one cut-off bar is attached near said first rib end and said second end of said at least one cut-off bar is positioned near said end of said bass bridge which supports said highest bass string.

* * * * *